United States Patent [19]

Gruia

[11] Patent Number: 4,921,595

[45] Date of Patent: May 1, 1990

[54] PROCESS FOR REFRACTORY COMPOUND CONVERSION IN A HYDROCRACKER RECYCLE LIQUID

[75] Inventor: Adrian J. Gruia, Lake Bluff, Ill.

[73] Assignee: UOP, Des Plaines, Ill.

[21] Appl. No.: 342,263

[22] Filed: Apr. 24, 1989

[51] Int. Cl.[5] ..... C10G 65/10

[52] U.S. Cl. ..... 208/59; 208/99; 208/100; 208/111

[58] Field of Search ..... 208/59, 111, 99, 57, 208/100

[56] References Cited

U.S. PATENT DOCUMENTS

| | | | |
|---|---|---|---|
| 3,037,930 | 6/1962 | Mason | 208/112 |
| 3,043,770 | 7/1962 | Kant et al. | 208/112 |
| 3,544,448 | 12/1970 | Jacobs et al. | 208/59 |
| 3,891,539 | 6/1975 | Nelson et al. | 208/59 |
| 4,447,315 | 5/1984 | Lamb et al. | 208/111 |
| 4,618,412 | 10/1986 | Hudson et al. | 208/112 |
| 4,713,167 | 12/1987 | Reno et al. | 208/111 |
| 4,764,266 | 8/1988 | Chen et al. | 208/58 |
| 4,801,373 | 1/1989 | Corman et al. | 208/59 |
| 4,828,676 | 5/1989 | Sawyer et al. | 208/59 |

*Primary Examiner*—Anthony McFarlane

*Attorney, Agent, or Firm*—Thomas K. McBride; John G. Tolomei; John G. Cutts, Jr.

[57] ABSTRACT

A catalytic hydrocracking process which comprises: (a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to gain a substantial conversion to lower boiling products; (b) partially condensing the hydrocarbon effluent from the hydrocracking zone and separating the same into a lower boiling hydrocarbon product stream and an unconverted hydrocarbon stream boiling above about 400° F. (204° C.) and comprising trace quantities of 11+ ring heavy polynuclear aromatic compounds; (c) introducing at least a portion of the unconverted hydrocarbon stream boiling above about 400° F. (204° C.) and comprising trace quantities of 11+ ring heavy polynuclear aromatic compounds into a 11+ ring heavy polynuclear aromatic compound conversion zone containing a zeolitic hydrogenation catalyst having pore openings in the range from about 8 to about 15 Angstroms ($10^{-10}$ meters) and a hydrogenation component operated at conditions to selectively reduce the concentration of 11+ ring heavy polynuclear aromatic compounds; (d) condensing at least a portion of the resulting effluent from the conversion zone to produce a liquid stream comprising hydrogenated hydrocarbonaceous compounds and having a reduced concentration of 11+ ring heavy polynuclear aromatic compounds; and (e) recycling at least a portion of the liquid stream comprising hydrogenated hydrocarbonaceous compounds recovered in step (d) to the hydrocracking zone in step (a) as at least a portion of the liquid recycle stream.

18 Claims, 2 Drawing Sheets

PROCESS FOR REFRACTORY COMPOUND CONVERSION IN A HYDROCRACKER RECYCLE LIQUID

BACKGROUND OF THE INVENTION

The field of art to which this invention pertains is the hydrocracking of a hydrocarbonaceous feedstock having a propensity to form 11+ ring heavy polynuclear aromatic compounds without excessively fouling the processing unit. The 11+ ring heavy polynuclear aromatic compounds are considered to be refractory in a hydrocracking process, are thereby highly resistant to conversion in a hydrocracking reaction zone and are therefore undesirable components in the feed or recycle to a hydrocracking reaction zone. More specifically, the invention relates to a catalytic hydrocracking process which comprises: (a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to gain a substantial conversion to lower boiling products; (b) partially condensing the hydrocarbon effluent from the hydrocracking zone and separating the same into a lower boiling hydrocarbon product stream and an unconverted hydrocarbon stream boiling above about 400° F. (204° C.) and comprising trace quantities of 11+ ring heavy polynuclear aromatic compounds; (c) introducing at least a portion of the unconverted hydrocarbon stream boiling above about 400° F. (204° C.) and comprising trace quantities of 11+ ring heavy polynuclear aromatic compounds into a 11+ ring heavy polynuclear aromatic compound conversion zone containing a zeolitic hydrogenation catalyst having pore openings in the range from about 8 to about 15 Angstroms ($10^{-10}$ meters) and a hydrogenation component operated at conditions to selectively reduce the concentration of 11+ ring heavy polynuclear aromatic compounds; (d) condensing at least a portion of the resulting effluent from the conversion zone to produce a liquid stream comprising hydrogenated hydrocarbonaceous compounds and having a reduced concentration of 11+ ring heavy polynuclear aromatic compounds; and (e) recycling at least a portion of the liquid stream comprising hydrogenated hydrocarbonaceous compounds recovered in step (d) to the hydrocracking zone in step (a) as at least a portion of the liquid recycle stream.

INFORMATION DISCLOSURE

In U.S. Pat. No. 4,447,315 (Lamb et al), a method is disclosed for hydrocracking a hydrocarbon feedstock having a propensity to form polynuclear aromatic compounds which method includes contacting the hydrocarbon feedstock with a crystalline zeolite hydrocracking catalyst, contacting at least a portion of the resulting unconverted hydrocarbon oil containing polynuclear aromatic compounds with an adsorbent which selectively retains polynuclear aromatic compounds and recycling unconverted hydrocarbon oil having a reduced concentration of polynuclear aromatic compounds to the hydrocracking zone.

In U.S. Pat. No. 3,619,407 (Hendricks et al), a process is claimed to prevent fouling of the equipment in a hydrocracking process unit which comprises partially cooling the effluent from the hydrocracking zone to effect condensation of a minor proportion of the normally liquid hydrocarbons therein, thereby forming a polynuclear aromatic rich partial condensate and withdrawing a bleedstream of the partial condensate. The '407 patent acknowledges as prior art that the hereinabove mentioned fouling problem may also be solved by subjecting the recycle oil (the heavy portion of the hydrocracking zone effluent), or a substantial portion thereof, to atmospheric distillation or vacuum distillation to separate out a heavy bottom fraction containing polynuclear aromatic compounds.

In U.S. Pat. No. 4,698,146 (Gruia), a process is disclosed wherein a vacuum gas oil feed stream is prepared in a fractionation zone and converted in a hydrocracking zone. An unconverted vacuum gas oil stream containing polynuclear aromatic compounds and recovered from the effluent of the hydrocracking zone is introduced into the original feed preparation fractionation zone in order to remove and harvest the polynuclear aromatic compounds in a slop wax stream to prevent their recycle to the hydrocracking zone with the vacuum gas oil feed.

In U.S. Pat. No. 3,172,835 (Scott, Jr.), a process is disclosed wherein at least a portion of the recycle stream is hydrogenated to reduce the concentration of polynuclear aromatics therein.

In U.S. Pat. No. 4,618,412 (Hudson et al), a process is disclosed wherein at least a portion of the unconverted hydrocarbon oil in a hydrocracking process and containing polynuclear aromatic compounds is contacted with an iron catalyst to hydrogenate and hydrocrack the polynuclear aromatic hydrocarbon compounds and recycling the unconverted hydrocarbon oil having a reduced concentration of polynuclear aromatic compounds to the hydrocracking zone. The '412 patent claims the use of a catalyst to hydrogenate and hydrocrack the recycle stream which catalyst contains elemental iron and one or more of an alkali or alkaline-earth metal, or compound thereof. The '412 patent teaches that this catalyst may also be supported, preferably, on an inorganic oxide support including, but not limited to, the oxides of aluminum, silicon, boron, phosphorus, titanium, zirconium, calcium, magnesium, barium, mixtures of these and other components, clays, such as bentonite, zeolites and other aluminosilicate materials, e.g., montmorillonite.

BRIEF SUMMARY OF THE INVENTION

The present invention is a catalytic hydrocracking process which minimizes the fouling of the process unit with 11+ ring heavy polynuclear aromatic compounds by means of hydrogenating and converting at least a portion or slipstream of the recycle hydrocarbon liquid containing trace quantities of 11+ ring heavy polynuclear aromatic compounds in a 11+ ring heavy polynuclear aromatic compound conversion zone containing a zeolite hydrogenation catalyst having pore openings in the range from about 8 to about 15 Angstroms ($10^{-10}$ meters) and a hydrogenation component at hydrogenation conditions to selectively reduce the concentration of 11+ ring heavy polynuclear aromatic compounds. At least a portion of the effluent from the 11+ ring heavy polynuclear aromatic compound conversion zone is introduced into the hydrocracking reaction zone to become at least a portion of the unconverted recycle stream. These steps significantly minimize the introduction of the undesirable 11+ ring heavy polynuclear aromatic compounds into the hydrocracking zone.

One embodiment of the present invention relates to a catalytic hydrocracking process which comprises: (a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to gain a substantial conversion to lower boiling products; (b) partially condensing the hydrocarbon effluent from the hydrocracking zone and separating the same into a lower boiling hydrocarbon product stream and an unconverted hydrocarbon stream boiling above about 400° F. (204° C.) and comprising trace quantities of 11+ ring heavy polynuclear aromatic compounds; (c) introducing at least a portion of the unconverted hydrocarbon stream boiling above about 400° F. (204° C.) and comprising trace quantities of 11+ ring heavy polynuclear aromatic compounds into a 11+ ring heavy polynuclear aromatic compound conversion zone containing a zeolitic hydrogenation catalyst having pore openings in the range from about 8 to about 15 Angstroms ($10^{-10}$ meters) and a hydrogenation component operated at conditions to selectively reduce the concentration of 11+ ring heavy polynuclear aromatic compounds; (d) condensing at least a portion of the resulting effluent from the conversion zone to produce a liquid stream comprising hydrogenated hydrocarbonaceous compounds and having a reduced concentration of 11+ ring heavy polynuclear aromatic compounds; and (e) recycling at least a portion of the liquid stream comprising hydrogenated hydrocarbonaceous compounds recovered in step (d) to the hydrocracking zone in step (a) as at least a portion of the liquid recycle stream.

Another embodiment of the present invention relates to a catalytic hydrocracking process which comprises: (a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to gain a substantial conversion to lower boiling products; (b) partially condensing the hydrocarbon effluent from the hydrocracking zone and separating the same into a hydrogen-rich gaseous stream and a first normally liquid hydrocarbonaceous stream comprising lower boiling hydrocarbons, unconverted hydrocarbons boiling above about 400° F. (204° C.) and trace quantities of 11+ ring heavy polynuclear aromatic compounds; (c) introducing the first normally liquid hydrocarbonaceous stream recovered in step (b) into a vaporization zone to produce a second normally liquid hydrocarbonaceous stream comprising unconverted hydrocarbons boiling above about 400° F. (204° C.) and trace quantities of 11+ ring heavy polynuclear aromatic compounds, and a vaporous hydrocarbonaceous stream comprising the lower boiling hydrocarbons; (d) introducing at least a portion of the second normally liquid hydrocarbonaceous stream comprising unconverted hydrocarbons boiling above about 400° F. (204° C.) and trace quantities of 11+ ring heavy polynuclear aromatic compounds recovered in step (c) into a 11+ ring heavy polynuclear aromatic compound conversion zone containing a zeolitic hydrogenation catalyst having pore openings in the range from about 8 to about 15 Angstroms ($10^{-10}$ meters) and a hydrogenation component operated at conditions to selectively reduce the concentration of 11+ ring heavy polynuclear aromatic compounds; (e) condensing at least a portion of the resulting effluent from the conversion zone to produce a liquid stream comprising hydrogenated hydrocarbonaceous compounds and having a reduced concentration of 11+ ring heavy polynuclear aromatic compounds; and (f) recycling at least a portion of the liquid stream comprising hydrogenated hydrocarbonaceous compounds produced in step (e) to the hydrocracking zone in step (a) as at least a portion of the liquid recycle stream.

Other embodiments of the present invention encompass further details such as types and descriptions of feedstocks, hydrocracking catalysts, hydrogenation catalysts, and preferred operating conditions including temperature and pressures, all of which are hereinafter disclosed in the following discussion of each of these facets of the invention.

DETAILED DESCRIPTION OF THE INVENTION

Figure 1:
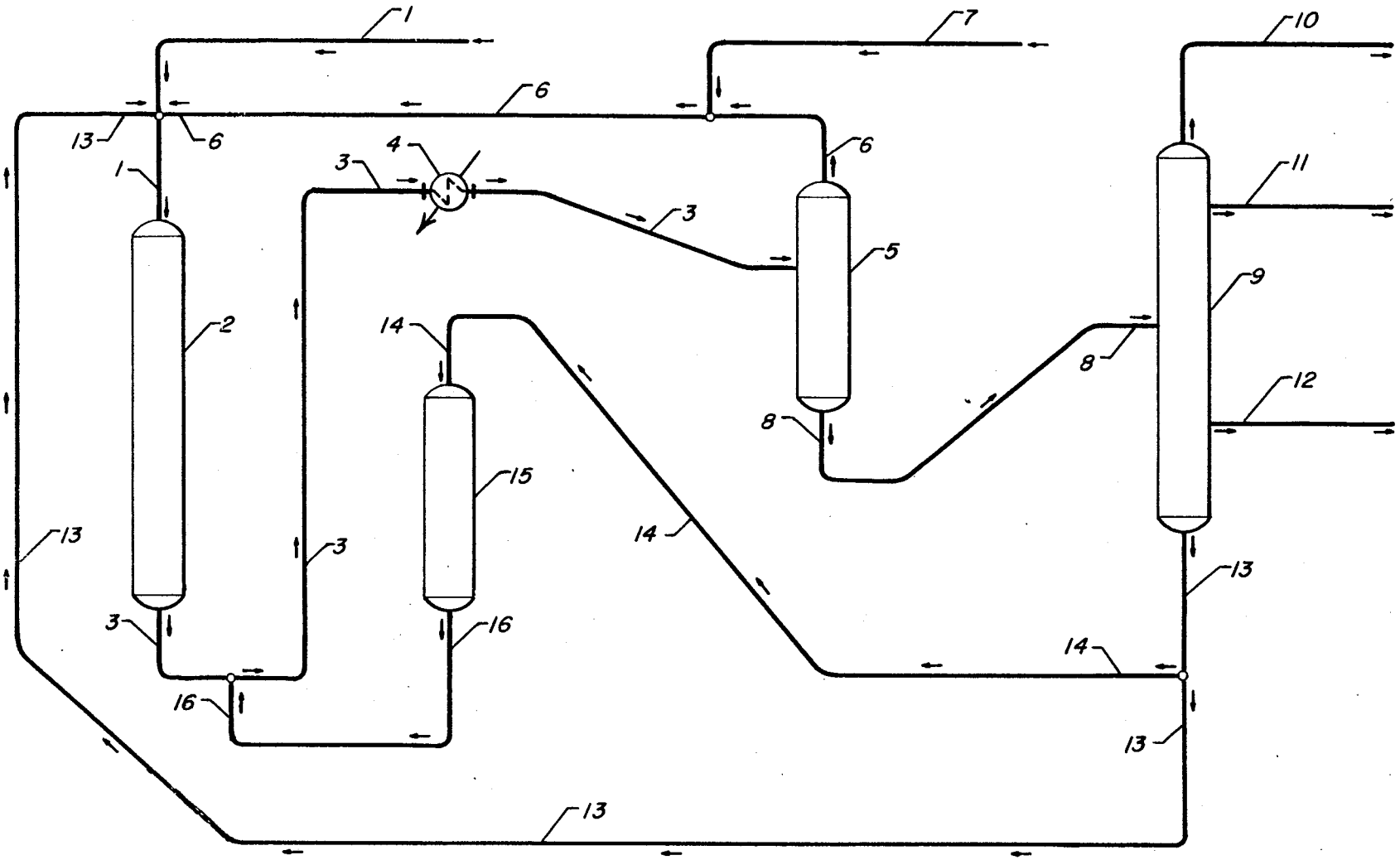
FIGS. 1 and 2 are simplified process flow diagrams of preferred embodiments of the present invention. The above described drawings are intended to be schematically illustrative of the present invention and not be a limitation thereof.

It has been discovered that a total recycle of unconverted oil can be maintained indefinitely in the above described hydrocracking process unit without encountering the above noted fouling or precipitation problems.

It has also been discovered that the polynuclear aromatic compounds which are primarily responsible for the fouling problems associated with the high conversion of hydrocarbon feedstock in a hydrocracking zone possess 11+ aromatic rings. Therefore, it becomes highly desirable to minimize the concentration of 11+ ring heavy polynuclear aromatic compounds (HPNA) which are recycled to the hydrocracking reaction zone in order to ensure trouble free operation and long run length. The polynuclear aromatic compounds having less than about 11+ aromatic rings represent potentially valuable components and precursors of the eventual hydrocracked product. Therefore, the indiscriminant and non-selective hydrogenation or conversion of these valuable compounds is undesirable because of lessened economic advantage.

In accordance with the present invention, it has been discovered that when at least a portion of the unconverted hydrocarbon effluent from a hydrocracking reaction zone containing trace quantities of 11+ ring heavy polynuclear aromatic compounds is introduced into a 11+ ring heavy polynuclear aromatic compound conversion zone containing a zeolitic hydrogenation catalyst having pore openings in the range from about 8 to about 15 Angstroms ($10^{-10}$ meters) and a hydrogenation component operated at hydrogenation conditions, a significant portion of the 11+ ring heavy polynuclear aromatic compounds is hydrogenated and converted to smaller molecules, and thereby prevented from being introduced into the hydrocracking zone.

Until the present time, the available literature, including issued patents, has taught that zeolitic catalysts are responsible for or are at least present during the formation of 11+ ring heavy polynuclear aromatic compounds. I have unexpectedly discovered that when an unconverted recycle stream from a hydrocracking zone contains 11+ ring heavy polynuclear aromatic compounds is contacted with a zeolitic hydrogenation catalyst having pore openings in the range from about 8 to about 15 Angstroms ($10^{-10}$ meters) and a hydrogenation component at hydrogenation conditions, the concentration of 11+ ring heavy polynuclear aromatic compounds is significantly reduced.

In some cases where the concentration of HPNA foulants is small, only a portion of unconverted hydrocracking zone effluent oil may need to be hydrogenated with the zeolitic hydrogenation catalyst to remove a substantial portion of the 11+ ring heavy polynuclear aromatic compounds in the recycle stream in order to maintain the 11+ ring heavy polynuclear aromatic compounds at concentration levels below that which promote precipitation and subsequent plating out on heat exchanger surfaces. The expression "trace quantities of $11^{30}$ ring heavy polynuclear aromatic compounds" as used herein is preferably described as a concentration of less than about 10,000 parts per million (PPM) and more preferably less than about 5,000 PPM.

The hydrocarbonaceous feed stock subject to processing in accordance with the process of the present invention preferably comprises a component selected from the group consisting of a vacuum gas oil, light cycle oil, heavy cycle oil, demetallized oil and coker gas oil.

The selected feedstock is introduced into a hydrocracking zone. Preferably, the hydrocracking zone contains a catalyst which comprises in general any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves, and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12, and even more preferably between about 4 and 8. Suitable zeolites found in nature include for example mordenite, stilbite, heulandite, ferrierite, dachiardite, chabazite, erionite and faujasite. Suitable synthetic zeolites include for example the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in this preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking conditions which include a temperature from about 450° F. (232° C.) to about 850° F. (454° C.), a pressure from about 500 psig (3448 kPa gauge) to about 3000 psig (20685 kPa gauge), a liquid hourly space velocity (LHSV) from about 0.2 to about 20 $hr.^{-1}$, and a hydrogen circulation rate from about 2000 (337 normal $m^3/m^3$) to about 15,000 (2528 normal $m^3/m^3$) standard cubic feet per barrel.

After the hydrocarbonaceous feedstock has been subjected to hydrocracking as hereinabove described, a product stream boiling at a temperature less than the feedstock is separated and recovered, and a hydrocarbonaceous stream preferably boiling at a temperature greater than about 400° F. (204° C.) is separated and recovered as a recycle stream. This separation and recovery is preferably conducted in a fractionation zone associated with the hydrocracking zone.

In one preferred embodiment of the present invention, the resulting liquid effluent from the hydrocracking catalyst zone is preliminarily fractionated into a heavy hydrocarbonaceous bottom fraction containing 11+ ring heavy polynuclear aromatic compounds and a lower boiling fraction containing hydrocarbonaceous products. The lower boiling fraction is subsequently fractionated to produce desired product streams such as, gasoline, kerosene and diesel fuel, for example. The heavy hydrocarbonaceous bottom fraction containing 11+ ring heavy polynuclear aromatic compounds is introduced into a hydrogenation reaction zone containing a zeolitic hydrogenation catalyst having pore openings in the range from about 8 to about 15 Angstroms ($10^{-10}$ meters) and a hydrogenation component operated at hydrogenation conditions to selectively reduce the concentration of 11+ ring heavy polynuclear aromatic compounds.

In another preferred embodiment of the present invention, the resulting liquid effluent from the hydrocracking catalyst zone is directly fractionated to produce desired product streams such as, gasoline, kerosene and diesel fuel, for example, and a heavy hydrocarbonaceous bottom fraction containing 11+ ring heavy polynuclear aromatic compounds. At least a portion of the resulting heavy hydrocarbonaceous bottom fraction containing 11+ ring heavy polynuclear aromatic compounds is introduced into a hydrogenation reaction zone containing a zeolitic hydrogenation catalyst having pore openings in the range from about 8 to about 15 Angstroms ($10^{-10}$ meters) and a hydrogenation component operated at hydrogenation conditions to selectively reduce the concentration of 11+ ring heavy polynuclear aromatic compounds.

The resulting heavy hydrocarbonaceous stream having trace quantities of 11+ ring heavy polynuclear aromatic compounds is introduced into a catalytic hydrogenation conversion zone containing hydrogenation catalyst and maintained at hydrogenation conditions selected to reduce the concentration of 11+ ring heavy polynuclear aromatic compounds. The catalytic hydrogenation conversion zone may contain a fixed, ebullated or fluidized catalyst bed. This reaction zone is preferably maintained under an imposed pressure from about atmospheric (0 kPa gauge) to about 3000 psig (20685 kPa gauge) and more preferably under a pressure from about 100 psig (689.5 kPa gauge) to about 2800 psig (19306 kPa gauge). Suitably, such reaction is conducted with a maximum catalyst bed temperature in the range of about 122° F. (50° C.) to about 850° F. (454° C.) selected to perform the desired hydrogenation conversion to reduce or eliminate the undesirable 11+ ring heavy polynuclear aromatic compounds contained in the hydrocarbonaceous feed to the hydrogenation zone. In accordance with the present invention, the primary function of the hydrogenation zone is to hydrogenate and convert 11+ ring heavy polynuclear aromatic compounds, however, it is contemplated that hydrogenation conversion may also include, for example, desulfurization, denitrification, olefin saturation and mild hydrocracking. Further preferred operating conditions include liquid hourly space velocities in the range from about 0.05 $hr^{-1}$ to about 20 $hr^{-1}$ and hydrogen circulation rates from about 200 standard cubic feet per barrel (SCFB) (33.71 normal $m^3/m^3$) to about 50,000 SCFB (8427 normal $m^3/m^3$), preferably from about 300 SCFB (50.6 normal $m^3/m^3$) to about 30,000 SCFB (5056 normal $m^3/m^3$).

The catalytic composite disposed within the hereinabove described hydrogenation conversion zone is characterized as containing a metallic component having hydrogenation activity, which component is combined with a carrier material of either synthetic or natural origin wherein said catalytic composite contains a zeolitic component and possesses pore openings in the range from about 8 to about 15 Angstroms ($10^{-10}$ meters). These characteristics of the hydrogenation catalyst are considered to be essential to the operability of the present invention. However, the precise composition and method of manufacturing the catalytic composite other than those stated are not considered essential to the present invention.

The hydrocarbonaceous effluent from the hydrogenation conversion zone is preferably cooled, partially condensed and admitted to a separation zone in order to separate a hydrogenated hydrocarbonaceous liquid phase having a reduced concentration of 11+ ring heavy polynuclear aromatic compounds and a hydrogen-rich gaseous phase which is preferably recycled. The resulting hydrogenated hydrocarbonaceous liquid phase having a reduced concentration of 11+ ring heavy polynuclear aromatic compounds is introduced into the product fractionation zone.

The resulting hydrogenated hydrocarbonaceous liquid phase is preferably recovered from the hydrogen-rich gaseous phase in a separation zone which is at essentially the same pressure as the hydrogenation reaction zone and as a consequence contains dissolved hydrogen and low molecular weight normally gaseous hydrocarbons if present. The resulting hydrogenated hydrocarbonaceous liquid having a reduced concentration of 11+ ring heavy polynuclear aromatic compounds is then introduced into the fractionation zone as described above.

In accordance with the present invention, the hydrocarbonaceous liquid stream containing 11+ ring heavy polynuclear aromatic compounds recovered from the product fractionation zone is preferably from about 2 volume percent to about 25 volume percent of the hydrocarbonaceous feedstock.

In the two drawings, two preferred embodiments of the present invention are illustrated by means of simplified flow diagrams in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art.

The zeolitic component or zeolite which is an essential component of the catalyst utilized in the hydrogenation zone of the present invention is sometimes referred to in the art as molecular sieves, and are usually composed of silica, alumina and one or more exchangeable cations such as sodium, hydrogen, magnesium, calcium, and rare earth metals, for example. A preferred zeolite for use in the present invention is a synthetic Y molecular sieve.

The naturally occurring zeolites are normally found in a sodium form, an alkaline earth metal form, or mixed forms. The synthetic zeolites are nearly always prepared first in the sodium form. In any case, for use as a component in the catalyst utilized in the hydrogenation zone of the present invention it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. The preferred zeolites are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions. The zeolite may be employed in undiluted form or the powdered zeolite may be mixed and copelleted with other relatively less active catalysts, diluents or binders such as alumina, silica gel, silica-alumina cogels, activated clays and the like in proportions ranging between about 5 and about 90 weight percent.

The preferred active metals employed in the hydrogenation catalyst of the present invention are cobalt, nickel, palladium and platinum. In addition to these metals, other promoters may also be employed in conjunction therewith, including the metals of Group VIB, e.g., molybdenum and tungsten. The amount of hydrogenating metal in the finished catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like, if desired, and calcined in air at temperatures of, e.g., 700°-1200° F. (371°-548° C.) in order to activate the catalyst and decompose ammonium ions. Alternatively, the zeolite component may first be pelleted, followed by the addition of the hydrogenating component and activation by calcining.

Another essential characteristic of the zeolitic hydrogenation catalyst utilized in the present invention is that the catalyst possesses pore openings in the range from about 8 to about 15 Angstroms ($10^{-10}$ meters). I have surprisingly and unexpectedly discovered that when a zeolitic hydrogenation catalyst contains pore openings in the range from about 8 to about 15 Angstroms ($10^{-10}$ meters), the 11+ ring heavy polynuclear aromatic compounds are hydrogenated thereby permitting greatly improved performance in the overall hydrocracking process while essentially eliminating the hereinabove described disadvantages of prior art hydrocracking processes. While not wishing to be bound by a theory or restricted thereby, I postulate that a hydrogenation catalyst, as described and used in accordance with the present invention, presents appropriate hydrogenation reaction sites which promote the desirable hydrogenation of 11+ ring heavy polynuclear aromatic compounds while simultaneously inhibiting condensation reactions which tend to generate additional 11+ ring heavy polynuclear aromatic compounds. Thus, the hydrogenation catalyst produces a net loss of 11+ ring heavy polynuclear aromatic compounds.

DESCRIPTION OF THE DRAWINGS

With reference now to FIG. 1, a vacuum gas oil feed stream is introduced into the process via conduit 1 and introduced into hydrocracking zone 2. A hydrocracked hydrocarbon stream having components boiling at a temperature less than about 650° F. (343° C.) is recovered from hydrocracking zone 2 via conduit 3. The hydrocracked hydrocarbon stream is transported via conduit 3, introduced into heat exchanger 4 to reduce the temperature of the flowing stream and is then introduced via conduit 3 into high pressure separator 5. A hydrogen-rich gaseous stream is removed from high pressure separator 5 via conduit 6, is admixed with make-up hydrogen provided via conduit 7 and the resulting admixture is introduced into hydrocracking zone 2 via conduit 6 and conduit 1. Since hydrogen is lost in the process by means of a portion of the hydrogen being dissolved in a hereinafter-described exiting liquid hydrocarbon, and hydrogen being consumed during the hydrocracking reaction, it is necessary to supplement the hydrogen-rich gaseous stream with make-up hydrogen from some suitable external source, for example, a catalytic reforming unit or a hydrogen plant. A hydrocracked hydrocarbon liquid stream is removed from high pressure separator 5 via conduit 8 and introduced into product fractionation zone 9. A product stream containing normally gaseous hydrocarbons and low boiling normally-liquid hydrocarbons is removed from product fractionation zone 9 via conduit 10 and recovered. A somewhat heavier hydrocarbon product stream is removed from product fractionation zone 9 via conduit 11 and recovered. An even heavier hydrocarbon product stream is removed from product fractionation zone 9 via conduit 12 and recovered. An unconverted hydrocarbonaceous stream containing 11+ ring heavy polynuclear aromatic compounds is removed from the bottom of product fractionation zone 9 via conduit 13 and transported via conduit 14 into hydrogenation zone 15 which contains a zeolitic hydrogenation catalyst. A hydrogenated hydrocarbonaceous stream containing a reduced concentration of 11+ ring heavy polynuclear aromatic compounds is removed from hydrogenation zone 15 via conduit 16 and is introduced into conduit 3 wherein it is joined with the effluent from hydrocracking zone 2 and is further processed as described hereinabove. Another portion of the unconverted hydrocarbonaceous stream is removed from the bottom of product fractionation zone 9 via conduit 13 and is admixed with the vacuum gas oil fresh feed stream and is introduced into hydrocracking zone 2 via conduit 1.

Figure 2:
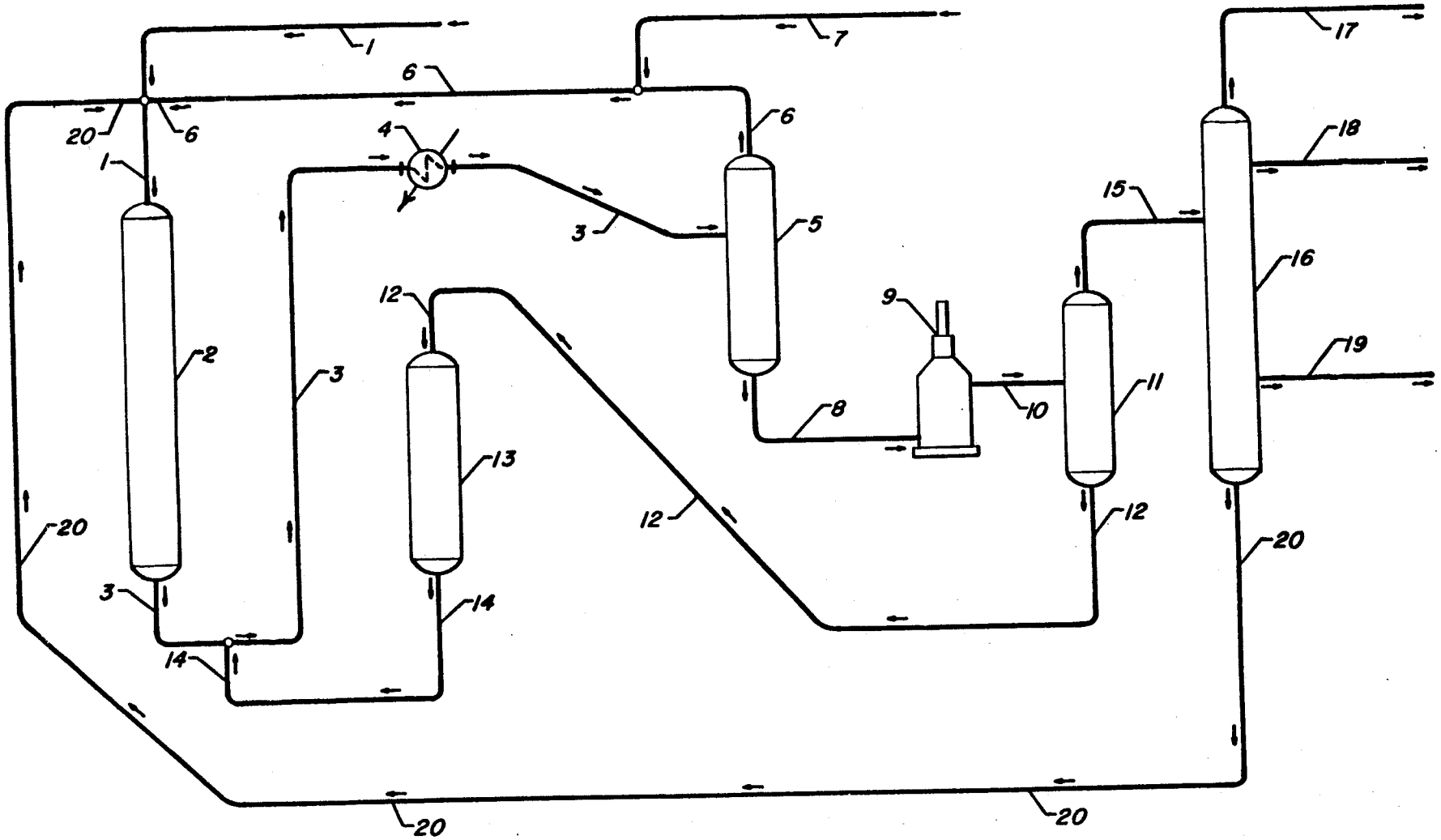

With reference now to FIG. 2, a vacuum gas oil feed stream is introduced into the process via conduit 1 and introduced into hydrocracking zone 2. A hydrocracked hydrocarbon stream having components boiling at a temperature less than about 650° F. (343° C.) is recovered from hydrocracking zone 2 via conduit 3. The hydrocracked hydrocarbon stream is transported via conduit 3, introduced into heat exchanger 4 to reduce the temperature of the flowing stream and is then introduced via conduit 3 into high pressure separator 5. A hydrogen-rich gaseous stream is removed from high pressure separator 5 via conduit 6, is admixed with make-up hydrogen provided via conduit 7 and the resulting admixture is introduced into hydrocracking zone 2 via conduit 6 and conduit 1. Since hydrogen is lost in the process by means of a portion of the hydrogen being dissolved in a hereinafter-described exiting liquid hydrocarbon, and hydrogen being consumed during the hydrocracking reaction, it is necessary to supplement the hydrogen-rich gaseous stream with make-up hydrogen from some suitable external source, for example, a catalytic reforming unit or a hydrogen plant. A hydrocracked hydrocarbon liquid stream is removed from high pressure separator 5 via conduit 8, introduced into heater 9 for heating and subsequently introduced via conduit 10 into pre-fractionation column 11. A liquid hydrocarbonaceous stream containing 11+ ring heavy polynuclear aromatic compounds is removed from prefractionation column 11 via conduit 12 and is introduced into hydrogenation zone 13 which contains a zeolitic hydrogenation catalyst. A hydrogenated hydrocarbonaceous stream containing a reduced concentration of 11+ ring heavy polynuclear aromatic compounds is removed from hydrogenation zone 13 via conduit 14 and is introduced into conduit 3 wherein it is joined with the effluent from hydrocracking zone 2 and is further processed as described hereinabove. A hydrocarbonaceous vapor stream is removed from pre-fractionation column 11 via conduit 15 and is introduced into product fractionation zone 16. A product stream containing normally gaseous hydrocarbons and low boiling normally-liquid hydrocarbons is removed from product fractionation zone 16 via conduit 17 and recovered. A somewhat heavier hydrocarbon product stream is removed from product fractionation zone 16 via conduit 18 and recovered. An even higher boiling hydrocarbon product stream is removed from product fractionation zone 16 via conduit 19 and recovered. An unconverted hydrocarbonaceous recycle stream is removed from the bottom of product fractionation zone 16 via conduit 20 and is admixed with the vacuum gas oil fresh feed stream and is introduced into hydrocracking zone 2 via conduit 1.

The following examples are given to illustrate further the catalytic hydrocracking process of the present invention. The examples are not to be construed as undue limitations on the generally broad scope of the invention as set out in the appended claims and are therefore intended to be illustrative rather than restrictive.

EXAMPLE I

A hydrocracker having a first bed of hydrocracking catalyst containing alumina, silica, nickel and tungsten followed in series by a second bed of hydrocracking catalyst containing alumina, crystalline aluminosilicate, nickel and tungsten, and having pore openings in the range from about 8 to about 15 Angstroms ($10^{-10}$ meters) was shut down to regenerate the two catalyst beds after operating in a high conversion mode. The crystalline aluminosilicate present in the latter catalyst was Y zeolite. The first bed of hydrocracking catalyst contained 78 volume percent of the total hydrocracking catalyst present in both beds of the hydrocracker. The catalyst regeneration was conducted by circulating a hot, inert gas containing a small amount of oxygen to slowly combust coke (carbon) which has been deposited upon the catalyst during the hydrocracking processing. By means of conventional stoichiometric calculation of the coke (carbon) combustion process, it was determined that the first bed of catalyst contained 14.7 weight percent carbon and that the second bed of catalyst contained 6.5 weight percent carbon. The results obtained during this regeneration are summarized and presented in Table 1.

TABLE 1

| HYDROCRACKER CATALYST REGENERATION SUMMARY | |
|---|---|
| First Bed Catalyst, Weight Percent Carbon | 14.7 |
| Second Bed Catalyst, Weight Percent Carbon | 6.5 |

These results dramatically show that the hydrocracking catalyst which contained Y zeolite having pore openings in the range of about 8 to about 15 Angstroms ($10^{-10}$ meters) contained significantly less carbon than the hydrocracking catalyst which contained no zeolite component. This result is believed to support the proposition that the zeolite containing catalyst is able to convert 11+ ring heavy polynuclear aromatic compounds and thereby preclude the condensation reactions which take place on non-zeolitic catalysts to form high levels of carbon.

EXAMPLE II

A hydrocracker having a first bed of hydrocracking catalyst containing alumina, silica, nickel and tungsten followed in series by a second bed of hydrocracking catalyst containing alumina, crystalline aluminosilicate, nickel and tungsten, and having pore openings in the range from about 8 to about 15 Angstroms ($10^{-10}$ meters) was operated in a high conversion mode with a feedstock having the characteristics presented in Table 2. The crystalline aluminosilicate present in the latter catalyst was Y zeolite. The fresh feedstock contained 0 wppm 11+ ring heavy aromatic compounds. Virgin hydrocarbonaceous feedstocks are generally considered by artisans to contain no detectable heavy polynuclear aromatic compounds. The hydrocarbon liquid effluent from the first bed was sampled, analyzed and found to contain 26.8 mass units per hour of 11+ ring heavy polynuclear aromatic compounds. The hydrocarbon fractionator bottoms stream which is subsequently recycled to the hydrocracking catalyst beds was sampled, analyzed and found to contain 10.5 mass units per hour of 11+ ring heavy polynuclear aromatic compounds. Essentially all, if not all, of the 11+ ring heavy polynuclear aromatic compounds exiting the second bed of hydrocracking catalyst are found in the fractionator bottoms stream. The results obtained hereinabove are summarized and presented in Table 3.

TABLE 2

| HYDROCRACKER FEEDSTOCK ANALYSIS | | |
|---|---|---|
| Specific Gravity/API Gravity | 0.8963/26.4 | |
| Distillation, Volume Percent | | |
| IBP, °F. (°C.) | 581 | (305) |
| 10 | 680 | (360) |
| 50 | 817 | (436) |
| 90 | 950 | (510) |
| 95 | 986 | (530) |
| End Point, Recovery 98% | 1022 | (550) |
| 11+ Ring Heavy Aromatic Compounds, wppm 0 | | |

TABLE 3

| 11⁻ RING HEAVY POLYNUCLEAR AROMATIC COMPOUND SURVEY | |
|---|---|
| | 11⁻ Ring Heavy Polynuclear Aromatic Compound Flow Rate, Mass Units/Hour |
| 1st Catalyst Bed Liquid Effluent | 26.8 |
| Fractionator Bottoms Liquid | 10.5 |

These results dramatically show that in an example of a prior art hydrocracking process when the combined feed, i.e., the fresh feed plug recycle passed through the first bed of hydrocracking catalyst containing no zeolite, the level of 11+ ring heavy polynuclear aromatic compounds increased from 10.5 mass units/hour to 26.8 mass units/hour. When the effluent from the first catalyst bed was passed through the second bed of hydrocracking catalyst containing a zeolitic component and having pore openings in the range from about 8 to about 15 Angstroms ($10^{-10}$ meters), the level of $11^{30}$ ring heavy polynuclear aromatic compounds decreased from 26.8 mass units per hour to 10.5 mass units per hour. Thus, a catalyst containing a zeolitic component having pore openings in the range from about 8 to about 15 Angstroms ($10^{-10}$ meters) demonstrated the ability to convert and thereby reduce the concentration of 11+ ring heavy polynuclear aromatic compounds.

The foregoing description, drawings and examples clearly illustrate the advantages encompassed by the process of the present invention and the benefits to be afforded with the use thereof.

What is claimed:

1. A catalytic hydrocracking process which comprises:

(a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to gain a substantial conversion to lower boiling products;

(b) partially condensing the hydrocarbon effluent from said hydrocracking zone and separating the same into a lower boiling hydrocarbon product stream and an unconverted hydrocarbon stream boiling above about 400° F. (204° C.) and comprising trace quantities of 11+ ring heavy polynuclear aromatic compounds;

(c) introducing at least a portion of said unconverted hydrocarbon stream boiling above about 400° F. (204° C.) and comprising trace quantities of 11+ ring heavy polynuclear aromatic compounds into a 11+ ring heavy polynuclear aromatic compound conversion zone containing a zeolitic hydrogenation catalyst having pore openings in the range from about 8 to about 15 Angstroms ($10^{-10}$ meters) and a hydrogenation component operated at conditions to selectively reduce the concentration of 11+ ring heavy polynuclear aromatic compounds;

(d) condensing at least a portion of the resulting effluent from said conversion zone to produce a liquid stream comprising hydrogenated hydrocarbonaceous compounds and having a reduced concentration of 11+ ring heavy polynuclear aromatic compounds; and (e) recycling at least a portion of said liquid stream comprising hydrogenated hydrocarbonaceous compounds recovered in step (d) to said hydrocracking zone in step (a) as at least a portion of said liquid recycle stream.

2. The process of claim 1 wherein said hydrocracking zone is maintained at a pressure from about 500 psig (3448 kPa gauge) to about 3000 psig (20685 kPa gauge).

3. The process of claim 1 wherein said hydrocracking zone is maintained at a temperature from about 450° F. (232° C.) to about 850° F. (454° C.).

4. The process of claim 1 wherein said metal promoted hydrocracking catalyst comprises synthetic faujasite.

5. The process of claim 1 wherein said metal promoted hydrocracking catalyst comprises nickel and tungsten.

6. The process of claim 1 wherein said hydrocarbonaceous feedstock boils at a temperature greater than about 650° F. (343° C.).

7. The process of claim 1 wherein said 11+ ring heavy polynuclear aromatic compound conversion zone is operated at conditions which include a temperature from about 200° F. (93° C.) to about 700° F. (371° C.), a pressure from about 200 psig (1379 kPa gauge) to about 2000 psig (13790 kPa gauge), a liquid hourly space velocity from about 0.01 to about 10 $hr^{-1}$ and a hydrogen circulation rate from about 500 SCFB (84.2 normal $m^3/m^3$) to about 10,000 SCFB (1685 normal $m^3/m^3$).

8. The process of claim 1 wherein said zeolitic hydrogenation catalyst comprises Y zeolite, nickel and tungsten.

9. The process of claim 1 wherein said hydrocarbonaceous feedstock having a propensity to form 11+ ring heavy polynuclear aromatic compounds comprises a component selected from the group consisting of vacuum gas oil, light cycle oil, heavy cycle oil, demetallized oil and coker gas oil.

10. A catalytic hydrocracking process which comprises:

(a) contacting a hydrocarbonaceous feedstock having a propensity to form 11+ ring heavy polynuclear aromatic compounds and a liquid recycle stream in a hydrocracking zone with added hydrogen and a metal promoted hydrocracking catalyst at elevated temperature and pressure sufficient to gain a substantial conversion to lower boiling products;

(b) partially condensing the hydrocarbon effluent from said hydrocracking zone and separating the same into a hydrogen-rich gaseous stream and a first normally liquid hydrocarbonaceous stream comprising lower boiling hydrocarbons, unconverted hydrocarbons boiling above about 400° F. (204° C.) and trace quantities of 11+ ring heavy polynuclear aromatic compounds;

(c) introducing said first normally liquid hydrocarbonaceous stream recovered in step (b) into a vaporization zone to produce a second normally liquid hydrocarbonaceous stream comprising unconverted hydrocarbons boiling above about 400° F. (204° C.) and trace quantities of 11+ ring heavy polynuclear aromatic compounds, and a vaporous hydrocarbonaceous stream comprising said lower boiling hydrocarbons;

(d) introducing at least a portion of said second normally liquid hydrocarbonaceous stream comprising unconverted hydrocarbons boiling above about 400° F. (204° C.) and trace quantities of 11+ ring heavy polynuclear aromatic compounds recovered in step (c) into a 11+ ring heavy polynuclear aromatic compound conversion zone containing a zeolitic hydrogenation catalyst having pore openings in the range from about 8 to about 15 Angstroms ($10^{-10}$ meters) and a hydrogenation component operated at conditions to selectively reduce the concentration of 11+ ring heavy polynuclear aromatic compounds;

(e) condensing at least a portion of the resulting effluent from said conversion zone to produce a liquid stream comprising hydrogenated hydrocarbonaceous compounds and having a reduced concentration of 11+ ring heavy polynuclear aromatic compounds; and (f) recycling at least a portion of said liquid stream comprising hydrogenated hydrocarbonaceous compounds produced in step (e) to said hydrocracking zone in step (a) as at least a portion of said liquid recycle stream.

11. The process of claim 10 wherein said hydrocracking zone is maintained at a pressure from about 500 psig (3448 kPa gauge) to about 3000 psig (20685 kPa gauge).

12. The process of claim 10 wherein said hydrocracking zone is maintained at a temperature from about 450° F. (232° C.) to about 850° F. (454° C.).

13. The process of claim 10 wherein said metal promoted hydrocracking catalyst comprises synthetic faujasite.

14. The process of claim 10 wherein said metal promoted hydrocracking catalyst comprises nickel and tungsten.

15. The process of claim 10 wherein said hydrocarbonaceous feedstock boils at a temperature greater than about 650° F. (343° C.)

16. The process of claim 10 wherein said zeolitic hydrogenation catalyst comprises Y zeolite, nickel and tungsten.

17. The process of claim 10 wherein said 11+ ring heavy polynuclear aromatic compound conversion zone is operated at conditions which include a temperature from about 200° F. (93° C.) to about 700° F. (371° C.), a pressure from about 200 psig (1379 kpa gauge) to about 2000 psig (13790 kPa gauge), a liquid hourly space velocity from about 0.01 to about 10 $hr^{-1}$ and a hydrogen circulation rate from about 500 SCFB (84.2 normal $m^3/m^3$) to about 10,000 SCFB (1685 normal $m^3/m^3$).

18. The process of claim 10 wherein said hydrocarbonaceous feedstock having a propensity to form 11+ ring heavy polynuclear aromatic compounds comprises a component selected from the group consisting of vacuum gas oil, light cycle oil, heavy cycle oil, demetallized oil and coker gas oil.

* * * * *